United States Patent [19]

Martin et al.

[11] 4,434,521

[45] Mar. 6, 1984

[54] APPLICATOR FOR APPLYING A COATING TO A SURFACE

[75] Inventors: Emil Martin, Pittsburgh; Herbert W. Barch, Natrona Heights; S. Thomas Greer, Pittsburgh, all of Pa.

[73] Assignee: PPG Industries, Inc., Pittsburgh, Pa.

[21] Appl. No.: 393,916

[22] Filed: Jun. 30, 1982

[51] Int. Cl.[3] ..... B05C 17/00; B05C 17/02

[52] U.S. Cl. ..... 15/230.11; 15/209 R; 15/227; 29/132; 428/290

[58] Field of Search ..... 15/209 R, 210 R, 230.11, 15/209 C, 209 D, 227; 29/110.5, 120, 121.8, 132; 428/290

[56] References Cited

U.S. PATENT DOCUMENTS

| | | | |
|---|---|---|---|
| 2,983,940 | 4/1961 | Beyer-Olsen | 15/181 |
| 3,183,578 | 5/1965 | Kennedy, Jr. | 29/120 |
| 3,441,355 | 4/1969 | Brown | 401/219 |
| 3,605,165 | 9/1971 | Burns | 15/210 |
| 3,611,469 | 10/1971 | Belli | 15/118 |
| 3,614,801 | 10/1971 | Peabody | 15/179 |
| 3,648,322 | 3/1972 | Meisner | 15/257.05 |
| 3,662,446 | 5/1972 | Walls | 29/130 |
| 3,717,896 | 2/1973 | Chase et al. | 15/210 R |
| 3,728,755 | 4/1973 | Whalen | 15/210 R |
| 3,736,616 | 6/1973 | Seip | 15/210 R |
| 3,763,533 | 10/1973 | Blom et al. | 29/132 |
| 3,774,278 | 11/1973 | Ashton | 29/116 R |
| 3,815,197 | 6/1974 | Sukenik | 29/132 |
| 3,821,829 | 7/1974 | Finnerty | 15/244 R |
| 3,837,988 | 9/1974 | Hennen et al. | 161/67 |
| 3,852,862 | 12/1974 | Sukenik | 29/132 |
| 3,920,596 | 11/1975 | Furukawa | 428/290 |
| 3,955,260 | 5/1976 | Sherden | 29/121 R |
| 4,191,792 | 3/1980 | Janssen | 427/260 |
| 4,228,208 | 10/1980 | Smith et al. | 428/95 |

OTHER PUBLICATIONS

Industrial Brushing, PPG Industries, Inc. Catalog 76-W.

*Primary Examiner*—Edward L. Roberts
*Attorney, Agent, or Firm*—Kenneth J. Stachel

[57] ABSTRACT

Coating compositions can be applied to substrates to produce a novelty finish by the use of a coating applicator having a mat of sized glass fibers and/or strands in contact with the coating. The novelty finish achieved with the glass fiber strand coating applicator has continuity of pattern, which is achieved in a fascile and efficient manner. The coating applicator has a core with an inner and outer surface and mat of sized glass fiber attached to the outer surface. The glass fibers have a residue of a sizing composition having a carrier, a film forming polymer, and compatible coupling agent. The one or more glass fibers may be selected from bulked, texturized, hollow, hollow with etching and solid continuous and staple glass fibers and mixtures thereof. The thickness of the mat on the core to comprise the applicator is in the range of about 0.125 to about 2 inches (3 to 50 mm.).

17 Claims, 5 Drawing Figures

APPLICATOR FOR APPLYING A COATING TO A SURFACE

The present invention is directed to an applicator such as a pad or a roller for applying coatings of varying viscosities to surfaces in order to achieve a novelty type of finish.

There are myriad methods of applying coatings to substrates ranging from dipping and the use of brushes and rolls to air spraying and electrostatic spraying. When the coating has a viscosity range of from around 100 to about 2,000 centipoise and when this coating is to be applied to substrates such as walls, paper board, plywood and pressed fiber boards, gypsum boards, metal sheet, strip or foils, irregular flat items and irregularly shaped items, brushes, rolls and pads have traditionally been used to apply the coatings. These coatings having such a viscosity range can be aqueous latexes, emulsions and dispersions, organic-solvent lacquer solutions and dispersions, plastisol and organosol formulations, oleoresinous compositions and plastic monomers, and reacting formulations such as epoxies and polyesters. The particular coatings applied to particular substrates by brushes, rollers and pads include application of such applications as: architectural coatings, oil and latex based interior paints to plaster walls, paperboard, gypsum board or plywood walls, and exterior oil and latex paints to cement blocks, stucco and masonry, and floor paints to wood and concrete. The use of these applicators for applying these coating compositions to these surfaces and substrates are commonplace to most individuals, who are involved commercially in such activities, or who undertake such activities as amateurs.

More recently, a particular type of finish for a coating on a substrate has been gaining popularity. This is a novelty finish of the coating composition on a surface or substrate that has irregular surface characteristics such as a wrinkled or texturized appearance. Such finishes are accomplished by professionals by what might be termed as tricks of the trade. Such tricks of the trade for applying these coatings to achieve a novelty finish include the processes of scoring, gouging, displacing or deforming parts of the coating already applied to the substrate. These procedures can be accomplished with such tools as brooms, sponges, combs, corrugated material, trowels and the like. These tools are used to give a swirl pattern to the coating composition, which can range from a paint to plaster. Another procedure for achieving a novelty finish is by dabbing the coating composition onto the substrate. This procedure is accomplished with such tools as blades, spatulas, trowels, paint brushes, crumpled material and the like. By this procedure, the coating is applied to the substrate in small portions with these tools leaving the rough surface from the dabbing technique to result in the novelty finish. All of these tricks of the trade are not well known or readily usable by a majority of amateurs in the general public, who may undertake to apply coatings to the aforementioned types of surfaces and substrates in a "do-it-yourself" manner.

The trade has developed specialized rollers to apply coatings to substrates such as walls, to achieve a texturized finish. The attempt in developing such rollers is to provide a method of producing a texturized finish that does not require a lot of effort in using a multi-faceted tool by a special technique or trick to produce a somewhat uniform texturized finish. These rollers are prepared from carpet fabrics, mohair fabrics and foam. The texturized finish produced with these rollers is somewhat limited to its degree of texturization, i.e., their use provides a limited number of texturized patterns for the finished surface.

An example of an applicator for applying ceiling texture material is shown in U.S. Pat. No. 3,955,260 (Sherden). This applicator has a plurality of spaced air pockets, which project outwardly in the form of nodules on the roller surface. These air pockets are defined by a thin plastic film. An example of a roller applicator for applying a coating material to achieve a texturized finish is given in U.S. Pat. No. 4,191,792. Here the roller has a surface comprised of an open web of interengaged continuous crinkled, coarse filaments of resilient material, which is bonded to the outer surface of a cylindrical roller core. The filaments of resilient material are those like thermoplastic polymers.

A problem that is experienced with all of the commercial fibrous applicators for applying coatings is the problem that after an initial use, most fibers, when wet with the coating media, tend to lump together producing an effect called rat tailing. Such an effect decreases the uniformity of the type of texturized finish that will be obtained and also decreases the reusability of these fibrous applicators. Another problem of the currently available fibrous applicators for coatings is that after a period of use, or if the fibers are in contact with the coating compositions for long periods of time, the fibers may swell and undergo dimensional change when wet. Another problem encountered with commercially available applicators after a period of initial use is that of slippage. The pad or roller applicators tend to slip during application of the coating to the substrate. Such slippage precludes formation of a continuity of pattern for the novelty finish on the substrate.

It is an object of the present invention to provide an applicator for applying a wide variety of coatings to substrates to produce a wide variety of novelty finishes with improved continuity of pattern in a fascile manner with reduced slippage.

SUMMARY OF THE INVENTION

Accordingly, these and other objects are achieved by the present invention, which is an applicator for applying coatings to a substrate, where the applicator has a surface of chemically treated glass fibers and/or strand and/or strands. The present invention is a coating applicator comprising a core having two surfaces and a mat of sized glass fiber and/or strand engaged to the outer surface of the core, where the glass fibers have a substantial portion of their surface covered with the dried residue of a chemical treating composition having at least a film forming polymer, compatible coupling agent and a carrier. The dried residue protects the glass fibers from abrasion during application of coatings and during any cleaning treatment for removing excess coating composition from the applicator.

The core can be constructed of any material capable of withstanding the stresses of holding a surface of fiberous mat or web, which becomes ladened with a coating composition for application to a substrate and the forces of moving the core with the surface of mat to dislodge the coating from the surface onto the substrate. The mat can be any mat of continuous and/or staple glass fibers and/or strand and/or strands, such as swirl mat or the like. The mat can have one or more continuous monofilaments or glass fiber or one or more strands having a plurality of glass fibers or a mixture of monofilaments and strand.

The one or more fibers and/or one or more glass fiber strands in the mat are held together by entanglements of the fibers and/or strands, and/or by chemical treatment. The entanglements and/or amount of chemical treatment in and on the mat must not be too great as to preclude capillary movement of the coating composition along the fibers and strands and into the interstices between the fibers and strands. The entanglements of the fibers and/or strands arise from the pattern at which the fibers and/or strands are laid to form the mat. The chemical treatment is a resinous binder placed on the mat during or after its formation.

DETAILED DESCRIPTION OF THE INVENTION

Figure 1:
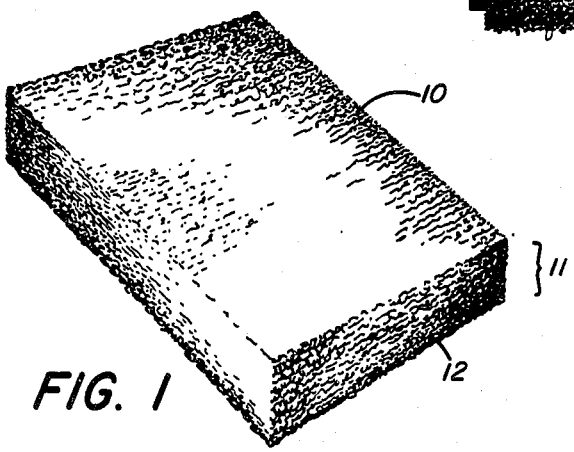
FIG. 1 is a plane view of the mat of continuous sized glass fiber strands used as the surface of the applicator.

FIG. 1 shows a glass fiber strand mat, where the strands are comprised of one or more fibers or one or more strands of glass fibers, where the fibers have a substantial portion of their surfaces coated with a residue of a chemical treating composition. The mat is depicted in FIG. 1 by numeral 10, the strand is depicted in FIG. 1 by numeral 12. The mat can be of any dimensions such as a rectangular pad fitted with a core (not shown in FIG. 1) and used in a pad applicator with a handle or other grasping or holding device, or used in a cylindrical form with a cylindrical core as a roller applicator, or used as the applicating surface of a painter's glove or mitt. Mat 10 is prepared from one or more chemically treated glass fibers, or a plurality of chemically treated glass fibers formed into one or more strands. Preferably, the mat is formed from continuous glass fiber strands. The mat can also have staple glass fibers or strands, where these staple fibers or strands are held in the mat by mechanical or chemical means.

The dimensions of the mat for use in the applicator can vary depending on the type of applicator, but the thickness or nap of the mat indicated by numeral 11 in FIG. 1 should be in the range of about 0.125 inch to about 2 inches (3 to 50 mm.). The thicker mats may produce favorable formation of a reservoir of the coating composition, when the mat is contacted with the coating composition to be applied to a substrate. Such a reservoir assists in the efficient transfer of the coating composition from the applicator to the substrate. Also, the mat has one or more fibers and/or strand and/or strands held together by fiber and/or strand entanglements and/or by chemical means to allow for adequate pick up and discharge of the coating by the applicator. The entanglememts or amount of chemical treatment is not so great as to give a packing characteristic of the fibers and/or strands in the mat that would preclude capillary action of the coating in the mat. The pick up and release of the coating composition to be applied to a substrate occurs by forcing the coating composition into the mat by dipping the mat into the coating or by spraying the coating onto the mat. Also, capillary action of the coating along the fibers and strands and through the interstices of the mat assists in the pick up of the coating composition by the mat. The discharge of the coating from the mat is effected by movement of the mat with applied pressure over the substrate. Therefore, the fibers and strands in the mat must be held together adequately by the fiber and/or strand entanglements or chemical treatment to permit the mat to maintain its integrity during these operations.

The mat of glass fibers is produced by drawing glass fibers and/or strands from a source into a feeder, which reciprocatingly traverses a mowing horizontal belt or rotating drum. The feeder lays down the glass fibers and/or strands as it reciprocates back and forth across the moving horizontal belt or rotating drum. The mass of glass fibers and/or strands on the belt can then be dried if the moisture content of the glass fibers and/or strands has not already been reduced from the moisture content of glass fiber strands as they are formed from a furnace. Also, the mat can be formed from a swirling motion of the feeder to give a swirl mat or the mat once formed can be passed through a needler to produce needled mat. Continuous glass fiber strand mat can be made by any method known to those skilled in the art, for example, by the method and apparatus of U.S. Pat. Nos. 3,154,836; 3,219,012; 3,265,481; 3,265,482; 3,469,796; 3,511,625, all herein incorporated by reference. Needled continuous glass fiber strand mat can be produced according to processes known to those skilled in the art on conventional needle looms and those of U.S. Pat. Nos. 3,664,909; 3,883,333; 3,915,681; 4,158,557 and 4,277,531, all of which are hereby incorporated by reference.

In all of these methods of producing mat of glass fiber and/or strand, when the fibers or strands are deposited on the belt or drum they usually become entangled to a degree. These entanglements result from the deflection of the fibers and/or strands off of a deflector which is close to the feeder or from the fibers and strands hitting the belt or drum. The entanglements provide mechanical integrity to the mat. In lieu of or in addition to entanglements, the mat may also have chemical integrity. This integrity can be provided by two approaches. One approach is to have extra chemical treatment present from the formation of the glass fibers. When a mat of these fibers or strands is heated or dried, any thermoplastic resinous or polymeric material in the residue on the glass fibers will flow and subsequently harden, when the heating or drying is terminated. This repositioned thermoplastic material may bridge various fibers or strands in the mat to provide some integrity. Another approach to provide integrity is by chemically treating the mat during or after its formation. Such a chemical treatment would have a resinous or polymeric binder which is applied to the mat to hold the fibers and/or strands together in the mat configuration.

The source of the glass fiber strand can be forming packages of continuous glass fiber strands, roving packages of continuous glass fiber strands and the like and gathered staple glass fibers and/or strands twisted to form continuous fibers or strands. Also glass fiber strands being formed directly from a bushing of a glass batch or glass melting furnace can be used. Eventually, the source of all of the glass fiber strands, whether they are in a forming package or roving package for production of the glass fiber strand mat, is the forming process of the glass fibers from a bushing in a furnace for melting glass batch or glass materials. The glass fibers are drawn from numerous orifices in the bushing, which is a heated platinum-containing device fitted into the furnace. The drawing force for drawing the fibers from the bushing and attenuating them is provided by the winder, which collects the glass fiber strand into a forming package or the rollers that deliver the fibers or strands to a chopper. The process for forming glass fibers is known as the mechanical pulling process. Other forming processes such as steam or air blowing, flame blowing and the like can be used.

In the forming processes, as the numerous glass fibers are attenuated and after they have cooled sufficiently, a chemical treatment is applied to them to protect them from intrafilament abrasion and to achieve a desired surface tension between the fibers and the coating composition to be applied to the surface or substrate. The chemical treatment is a solution, emulsion, dispersion or mixture having at least a carrier, film forming polymer and compatible coupling agent. The carrier can be an organic solvent or water in amounts to maintain the chemical treating composition in its soluble or dispersed form.

The film forming polymers used in the chemical treating composition are those that form a film on a substrate upon evaporation of the carrier. Nonexclusive examples include starch materials and thermoplastic and thermosetting polymer materials such as polyvinyl acetate, polyesters, epoxies including 1,2-epoxies, polyurethanes, ethylene vinylacetate copolymers, acrylic vinylacetate copolymers, acrylic polymers, homopolymers and other copolymers, water insoluble starches, gums, such as gum arabic, gum tragacanth and gum karay; glues, cellulosic materials such as carboxymethyl cellulose, hydroyethyl cellulose, methyl cellulose; oxyethylated stearates ureaformaldehyde polymers, melamine-formaldehyde polymers, acetoneformaldehyde polymers, phenol-formaldehyde polymers; alkyd resins such as glycerylphthalic anhydride reaction products; polyamides, saturated and unsaturated polyesters, hydrocarbon-siloxane resins, vinyl resins such as homopolymers and copolymers of ethylene, propylene, styrene, isobutylene, butadiene, acrylonitrile, vinyl chloride, vinyl pyrrolidone, vinylidene chloride, vinyl acetate, vinyl alcohol acrylic acid and ester thereof, methacrylic acid and esters thereof, and the like. Mixtures of these film-formers may also be employed. These film-formers are preferably used in the form of aqueous solutions or emulsions.

The particular film formers that are useful are polyvinyl acetate, polyvinyl pyrrolidone, polyacrylate and polymethacrylate esters, polyacrylamide, polymethacrylamide, saturated polyesters, unsaturated polyesters, epoxy resins, malemine resins, phenolic resins and copolymers and mixtures of these materials.

The film forming material in the sizing composition can be modified as can be other ingredients to achieve a desired surface tension for the glass fibers in the glass fiber strand to maximize or minimize pick up and release of the coating composition to be applied to a surface or substrate from the applicator of the present invention. The film forming polymer forms a film on the glass fibers, where a coupling agent is already present on the fiber, or where the coupling agent has been reacted with the film forming polymer.

The coupling agents used in the chemical treating composition can be silane coupling agents, titanate coupling agents and Werner complex coupling agents having various reactable groups on the molecule to react with the film forming polymer through acid base reaction to form salt products or organic reactions like addition polymerization through unsaturated functional groups. Particularly useful coupling agents include: aminofunctional silane coupling agents, like gamma-aminopropyltriethoxysilane, epoxy-functional silane coupling agents like gamma-glycidoxypropyltrimethoxysilane and silane coupling agents, where the organo reactive moiety is a free radically polymerizable moiety such as acrylate, methacrylate, alkyl, vinyl like gamma-methacryloxypropyltriethoxysilane.

The reactability of the coupling agent, which associates with the glass surface, and the film forming polymer is necessary to maintain the residue present on the glass fiber to protect them from abrasion during use. This use includes applying coating compositions to substrates and cleaning of the applicators for repeated usage. Some care in cleaning the applicators of the present invention is necessary so as not to cause unnecessary abrasion of the glass fibers.

Other examples of reactable systems of film forming polymers, coupling agents and some lubricants like fatty acid type lubricants such as those described in U.S. Pat. Nos. 2,946,701, 3,081,195 and 3,350,345 can be used. All of these patents are hereby incorporated by reference.

The numerous glass fibers have the chemical treatment applied to them by any method known to those skilled in the art. For example, roller applicators, spray applicators and the like can be used. After the chemical treatment is applied, the fibers are gathered into one or more strands and collected into a forming package on the winder or chopped and collected. The forming of the glass fiber strands by mechanical pulling can occur at such speeds as around 4,000 rpm to 7,500 rpms to produce strand travel speeds of around 12,000 to 15,000 feet per minute. Details of applicators used to apply the chemical treating compositions to the glass fibers are shown in U.S. Pat. No. 2,728,972, hereby incorporated by reference. A representative method of fiber formation and application of an aqueous chemical treatment is the process illustrated in FIG. 2 of U.S. Pat. No. 3,849,148 which is hereby incorporated by reference. The amount of dried residue present on the glass fiber can range from around 0.1 to around 5 weight percent of the dried, treated glass fibers and/or strands of glass fibers.

The glass fibers produced in the forming processes can have filament diameters ranging from submicron diameters to diameters on the order of 20 to 30 microns and preferably, about 1 to about 30 microns. The glass fibers are comprised of lime-aluminum-borosilicate glass, which is relatively soda free and, which is commonly referred to as "E" glass or "621" glass, although more environmentally acceptable derivatives thereof can also be used. Also, other glasses are useful such as the low soda glass known as "C" glass, or the soda-lime-silica glass referred to as "A" glass, or high strength glasses referred to as "S" or "HS" glass. The filaments that are prepared by the aforementioned processes can be solid fibers, crimped, bulked or texturized fibers or strands produced by the forming process or by a subsequent process, or the fibers can be hollow or hollow etched fibers. Any processes known to those skilled in the art may be used to produce these types of fibers and strands. For example, the hollow glass fibers are produced by a process such as that shown in U.S. Pat. Nos. 3,268,313; 3,421,873, and 3,510,393, all of which are hereby incorporated by reference. Also, the solid or hollow fibers may be treated with dilute acids to etch their surface or provide voids in their surfaces according to a process described in U.S. Pat. No. 4,046,948 (Zlochower) hereby incorporated by reference or any other process known to those skilled in the art.

Figure 2:
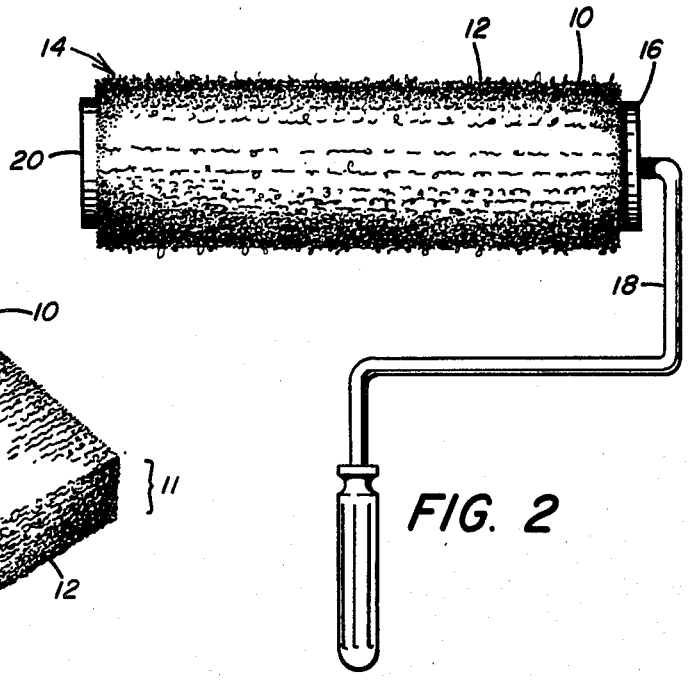
FIG. 2 is a plane view of the applicator in a roller construction showing the mat surface and the core attachable to a handle.

In FIG. 2 there is shown the applicator of the present invention having mat surface 10 in a roller construction 14. The continuous glass fiber strands, 12, within mat 10 are the same as those continuous glass fiber strands in mat 10 of FIG. 1. The mat 10 is attached to core 16 of roller 14. This attachment can be by any means known to those skilled in the art such as mechanical attachment or chemical attachment by means of adhesive bonding such as that achieved with epoxy adhesives. Core 16 with mat 10 makes up roller 14 which is engageable with a handle shown in FIG. 2 as handle 18 with the held portion of the handle in phantom. The core 16 can be of any material known to those skilled in the art for forming cores of a roller, such nonexclusive examples include wire, mesh, wood, paper cores and polymeric impregnated paper tubes such as phenolic impregnated paper tubes, and rigid foam or solid polymeric materials such as polypropylene, polyethylene, polyvinylchloride polymethacrylate and the like. The dimensions of the roller can be any dimensions suitable for adapting the roller with the core and mat to a handle for use in applying coatings to substrates. The roller can be engaged with a handle by any suitable frame, like 20 extending out from under core 16 and mat 10, known to those skilled in the art. The typical dimensions of a coating roller are a length of around 7, 9 and 11 inches (17.78, 22.86, and 27.94 cm) and the dimensions of the cylindrical core are around 1½ inches (3.8 cm) in diameter and about 0.05 inches (1.27 cm) in wall thickness.

In making the applicator of the present invention, any method of applying the continuous glass fiber strand mat to the core with the use of the mechanical or chemical means for attachments can be used. For example, the glass fiber strand mat can be cut to a size that is identical with the core and the adhesive applied to one surface of the mat and the surface of the mat with the adhesive is contacted with the core for a sufficient period of time and at sufficient temperatures to allow for an adequate bond. Also, the continuous glass fiber strand for a roller can be made by any method to eliminate a noticable seam on the cover such as by spiral winding of the mat onto the core, where the width of the strip of mat is less than the desired length of the roller. A typical example of such a process is to have a cylindical core with an inner and outer surface and a length longer than the length of the final roller. The mat is prepared into a strip which is narrower than the final length of the roller, a preferred length is around 3 inches (7.6 cm.). Adhesive is applied to one side of the strip and the strip is helically wound onto the cyclindrical core so that the strip lays in edge to edge relationship on the cylindrical core. The core with the covering of mat is cut to the desired length for a roller.

Figure 3:
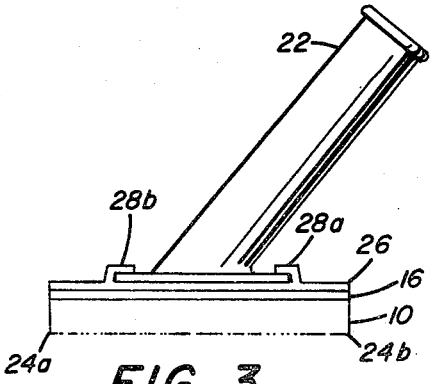
FIG. 3 is a side view of the applicator in a pad construction showing the mat surface and core attachable to a handle.

FIG. 3 shows the applicator of the present invention attached to a handle in a pad applicator construction. The mat of continuous sized glass fiber strands is shown at 10 with the core shown at 16. It is also possible in this instance, that the glass fiber strand mat can be attached directly to the rigid polymeric or metallic material frame 26 by a mechanical or chemical means. Also, it is possible that the paper type core as used in FIG. 2 can be present in between the glass fiber strand mat 10 and frame 26 as core 16, where the mat is attached to the paper type core and paper type core is then attached to the polymeric frame 26. The applicator in this embodiment includes a handle 22 which is attached to frame 26. Generally, the applicator pad has substantially parallel front and rear edges 24*a* and 24*b* and can have parallel or nonparallel side edges. In the pad form, the applicator can be of any dimension typically used in applicators such as the rectangular form or a form having substantially parallel front and rear edges and nonparallel side edges, which may converge toward each other in a forwardly to rearwardly direction. Also, the sides may converge upwardly and inwardly toward each other in a vertical fashion or may be parallel. The applicator includes a generally rigid backing member frame 26 having laterally extending front and rear flanges 28*a* and 28*b* along the front and rear edges thereof for attachment of the pad applicator to handle 22. Although any other attachment means other than 28*a* and 28*b* may be used, which are known to those skilled in the art, for attaching a pad assembly to a handle for a paint pad applicator. In addition, a compressible intermediate member preferably of a sponge-like substance or foam substance can be adhered to backing member frame 26 as separate sponge-like member in between the core 16 and frame 26 or the sponge-like member can be substituted for the core 16 and the glass fiber mat 10 bonded directly thereto by mechanical or chemical means.

Figure 4:
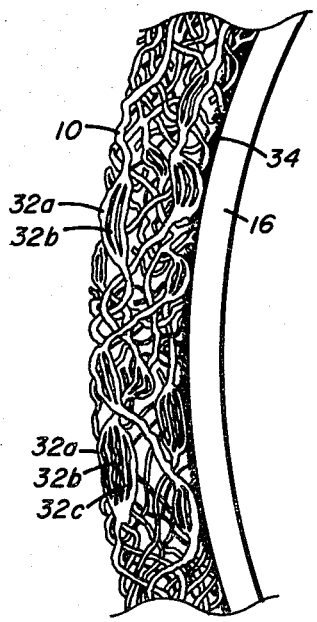
FIG. 4 is an enlarged and detailed view of a traverse section through the applicator of FIG. 2 illustrating the surface mat and core of the applicator.

FIG. 4 shows an enlarged view of the continuous glass fiber strand mat 10 in engagement with core 16 which as depicted in FIG. 4 is a portion of the cylindrical core of FIG. 2, although the core can also be flat or of any dimension for attachment to a handle. FIG. 4 shows that one or more continuous glass fiber strands are entangled to form the mat and that upon use the strand at the loop sections of the mat the loop may disassociate into one or more filaments depicted in FIG. 4 as 32*a, b* and *c*. The mat 10 is attached to core 16 by the use of any adhesive known to those skilled in the art for combining the mat to a paper polymeric or wire mesh, or sponge-like material. The adhesive is indicated in FIG. 4 by numeral 34. This adhesive is placed on one surface of the mat, which is then contacted to the core. The adhesive will not cover all of the glass fiber strands in the mat but will provide a maximum number of contact points between the mat and the core to allow for adequate adhesion of the entire mat without restricting all of the strands in the mat from moving in the various directions.

Figure 5:
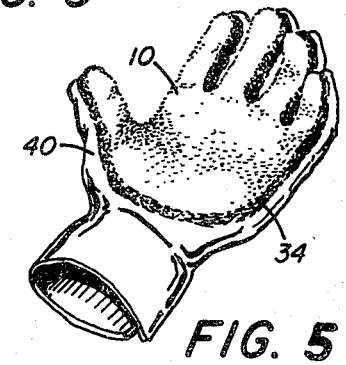
FIG. 5 is a plane view of the applicator in a painter's mitt or glove construction.

FIG. 5 depicts the applicator of the present invention as a painter's glove or mitt. Here mitt 40 is the core to which mat 10 is attached. The mat can occupy the palm portion of the mitt as indicated in FIG. 5, or it can occupy the entire front and reverse side of the mitt. The mitt can have fingers or merely a thumb and one common area for the fingers. The mat 10 is attached to glove core 40 by any mechanical or chemical means known to those skilled in the art. As shown in FIG. 5, the attachment can be by adhesive layer 34 or by stitching. When the entire mitt is covered with the mat 10, the mitt can actually be constructed of the mat and have a built-in liner to cover the hand.

PREFERRED EMBODIMENT

In the preferred embodiment of the present invention, the applicator can be of the pad or roller type, but the mat of continuous sized glass fiber strand preferably has numerous fibers making up the strand and the mat is comprised of numerous strands. The sizing composition preferably has a polyvinyl acetate film former, a fatty acid-type lubricant, and an organo reactable silane coupling agent with water as the carrier. Also, the strands making up the mat are of varied dimensions such as strands comprised of fibers with one size of filament diameter and strands comprised of fibers with another filament diameter, where the filament diameters most preferably range from about 5 microns to 20 microns. One of the strands for the varied construction can be those of G-150, which means a strand, where the fibers in the strand have an average filament diameter of between 8.9 and 10.16 microns and 15,000 yards of strand weighs one pound. This weight implies the strands consist of 200 filaments. Another strand in the mat may be a K-75 which means the fiber strand has an average filament diameter between 12.7 and 14.3 microns, while the 7,500 yards per pound would imply twice as many fibers per strand as the "G" or 400 fibers per strand. It is also possible that the strands could be a mixture of fibers having varying fiber diameters. It is also possible that the mat can be comprised of strand having various constructions while also having residues of various sizing compositions. Also, the mat could be constructed of a plurality of monofilaments having various filament or fiber diameters.

Preferably the mat of the present invention has a thickness or nap or about 0.125 to about 2 inches (3 to 50 mm.). Also the mat of the present invention is preferably a continuous glass fiber strand mat which is applied to a paper core impregnated with a phenolic polymer by the use of an epoxy resin adhesive.

The roller is made in a manner to eliminate any noticable seam. This is accomplished by helically winding the strip of mat around and adhesively secured to the core. With this end-to-end helical arrangement any edge of the strip, except for the edges at the ends of the roller are immediately adjacent to another edge of the strip along the longitudinal cylindrical surface of the roller.

The coating applicator of the present invention can be used to apply any coatings, aqueous based or oil based like those previously mentioned, having a viscosity in the range of about 50 to about 2,500 centipoise to any substrate like those previously enumerated. The usual wet coating thickness laid down by the applicator is in the range of about 0.001 to about 0.01 inch. The coating applied is preferably a latex paint and the finish to the coating is a texturized finish having a continuity of pattern throughout the finish. With the use of the applicator of the present invention, the advantages that are realized are among the following. Improved control is achieved for the coating applicator for parameters such as paint pick up, which is the amount of paint that the applicator will pick up in one given loading and the discharge rate, which is the rate at which the coating is distributed in terms of weight per square foot or mil thickness per square foot. Uniformity of application is achieved which is the manner in which the paint is distributed in terms of film smoothness. Better chemical and solvent resistant is achieved because of the chemical nature of glass fibers are unlike conventional cloth-like applicators and are more resistant to those chemicals and solvents used in coating compositions. Resistance to dimensional change is achieved when the applicator is wet, since fiber glass is less prone to dimensional change when subjected to water and other solvents for long periods of time because the fiber does not swell and maintains a high degree or rigidity. Maintenance of fiber continuity is achieved, whereas most fibers when wet in coating media tend to lump together producing an effect called rat tailing, but the glass fiber strands because of adjustable surface tension via chemical treatment and because of maintenance of rigidity of the fiber itself eliminates this condition.

While the invention has been described with reference to certain specific examples and illustrative embodiments, this is for illustrative purposes only and is not intended to limit the invention except insofar as appears in the accompanying claims.

We claim:

1. A coating applicator comprising:

a. a core having an inner and outer surface surface, where the core is adaptable for being held;

b. a mat of one or more glass fibers engaged to the outer surface of the core, where the one or more glass fibers have on a substantial portion of their surface the dried residue of a treating composition of a carrier, film forming polymer, and compatible coupling agent.

2. Applicator of claim 1, wherein the core is cylindrical and the mat is attached to the outer surface of the core to form a roller applicator which is adaptable for holding by means of a handle.

3. Applicator of claim 2, wherein the mat is helically wound onto the outer surface of the cylindrical core in end to end arrangement to provide a continuous covering over substantially the entire outer cylindrical surface.

4. Applicator of claim 1, wherein the core is flat having two surfaces and the mat is attached to one surface of the core and the other surface of the core is attached to a backing member for engagement with a handle.

5. Apparatus of claim 1 wherein the core is a sponge-like substance.

6. Applicator of claim 1, wherein the film former is polyvinyl acetate.

7. Applicator of claim 1, wherein the treating composition also has a lubricant.

8. Applicator of claim 7, wherein the lubricant is a fatty acid-type lubricant.

9. Applicator of claim 1, wherein the coupling agent is an amino-containing silane coupling agent.

10. Applicator of claim 1, wherein the core is a painter's glove and the mat is attached to the outside of the glove.

11. Applicator of claim 1, wherein the glass fibers are in the form of one or more glass fiber strands.

12. Applicator of claim 11, wherein the glass fiber strands within the mat are continuous and have a varying construction so that strands having filaments with different filament diameters from the filaments in other strands are present and the filament diameter of the filaments in all of the strands range from submicron to about 30 microns.

13. Applicator of claim 11, wherein the mat has a thickness in the range of about 0.125 to about 2 inches.

14. Applicator of claim 11, wherein the glass fiber strands comprising the mat are continuous and selected from the group consisting of bulked, crimped, texturized, hollow, hollow-etched and solid and mixtures thereof and where the filaments within the strands have a fiber diameter ranging from submicron to micron sizes of 30 microns.

15. Applicator of claim 11, wherein the fiber diameter is in the range of about 5 to 20 microns.

16. Applicator of claim 11, wherein the strands have integrity in the mat by strand entanglements.

17. Applicator of claim 11, wherein the strands have integrity in the mat by a chemical binder.

* * * * *

UNITED STATES PATENT AND TRADEMARK OFFICE

CERTIFICATE OF CORRECTION

PATENT NO. : 4,434,521

DATED : March 6, 1984

INVENTOR(S) : Emil Martin, Herbert W. Barch, S. Thomas Greer

It is certified that error appears in the above-identified patent and that said Letters Patent is hereby corrected as shown below:

Column 10, line 21, delete the word, first occurrence, of "surface".

Signed and Sealed this

*Sixteenth* Day of *October 1984*

[SEAL]

*Attest:*

GERALD J. MOSSINGHOFF

*Attesting Officer*

*Commissioner of Patents and Trademarks*